US008282099B2

(12) United States Patent
Oshida

(10) Patent No.: US 8,282,099 B2
(45) Date of Patent: Oct. 9, 2012

(54) DELIVERY MECHANISM, FIXING DEVICE AND IMAGE FORMING APPARATUS

(75) Inventor: Hideo Oshida, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/566,171

(22) Filed: Sep. 24, 2009

(65) Prior Publication Data

US 2010/0013151 A1 Jan. 21, 2010

Related U.S. Application Data

(63) Continuation of application No. 11/184,897, filed on Jul. 20, 2005, now abandoned.

(30) Foreign Application Priority Data

Feb. 3, 2005 (JP) ..... 2005-027286

(51) Int. Cl.
*B65H 29/20* (2006.01)

(52) U.S. Cl. ..... 271/314; 271/207

(58) Field of Classification Search ..... 271/207, 271/314, 209; 492/30, 32
See application file for complete search history.

(56) References Cited

U.S. PATENT DOCUMENTS

| | | | | |
|---|---|---|---|---|
| 5,161,794 | A | 11/1992 | Adachi | |
| 6,089,567 | A | 7/2000 | Yatsuhashi et al. | |
| 6,298,214 | B1 | 10/2001 | Koga | |
| 6,488,279 | B1 | 12/2002 | Fukuda et al. | |
| 2006/0008305 | A1* | 1/2006 | Ito | 399/406 |
| 2006/0157922 | A1 | 7/2006 | Carter et al. | |

FOREIGN PATENT DOCUMENTS

| | | | |
|---|---|---|---|
| JP | 60-050651 | U | 4/1985 |
| JP | 62-171552 | U | 10/1987 |
| JP | 03-036153 | A | 2/1991 |
| JP | 7-17295 | B2 | 3/1995 |
| JP | 7-267398 | A | 10/1995 |
| JP | 8-246034 | A | 9/1996 |
| JP | 09-315615 | A | 12/1997 |
| JP | 63-008157 | A | 1/1998 |
| JP | 10-186738 | A | 7/1998 |
| JP | 11-079514 | A | 3/1999 |
| JP | 11-208957 | A | 8/1999 |

OTHER PUBLICATIONS

Japanese Notification of Reasons for Refusal dated Sep. 9, 2009 in Japanese Patent Appln. No. 2005-027286.

* cited by examiner

*Primary Examiner* — Luis A Gonzalez
(74) *Attorney, Agent, or Firm* — Sughrue Mion, PLLC

(57) ABSTRACT

A sheet delivery mechanism including: a first roll; a second roll; and a plurality of convexes formed circumferentially for pushing a rear end of a sheet to be delivered, wherein: a sheet delivery roll pair comprises the first roll and the second roll in contact with each other; at least one of the first roll and the second roll is provided with the plurality of convexes; and one of the plurality of convexes is arranged to be more inside radially than the tangential line drawn from the radial tip of another convex upstream adjacent in the rotating direction to the one convex at issue to the outer periphery of the roll.

5 Claims, 10 Drawing Sheets

DELIVERY MECHANISM, FIXING DEVICE AND IMAGE FORMING APPARATUS

CROSS-REFERENCE TO RELATED APPLICATION

This is a Continuation Application of U.S. application Ser. No. 11/184,897 filed Jul. 20, 2005; the entire disclosure of the prior application is considered part of the disclosure of the accompanying Continuation Application and is hereby incorporated by reference.

BACKGROUND OF THE INVENTION

1. Field of the Invention

This invention relates to a sheet delivery mechanism in an image forming apparatus such as a printer, copier or facsimile and a fixing device and the image forming apparatus having the sheet discharging mechanism.

2. Background Art

In the image forming apparatus, it is known that when a sheet with an image formed by an image forming section is delivered or discharged into an output tray, a paper delivery roll pair consisting of a follower roll and pinch roll which sandwich a nip are used.

Until now, a sheet delivery mechanism is known which is a sheet delivery roll serving as an inverting roll for both-side printing, provided with a slope on the side acting when the convex portion of the kicking shape of a pinch roll is inverted (JP-B-7-17295). Another paper delivery mechanism is known in which the rising angle of the convex of the kicking shape on the side acting in delivery is set at 45° or less (JP-A-11-79514). Still another paper delivery has been disclosed in which an elastic blade-like convex is provided so that in sheet feeding the convex is deformed inward in a radial direction and in kicking-out, the convex is acted on the sheet (JP-A-08-246034).

However, if the sheet is discharged with the rear end slanted downward in a certain degree according to the convex in the kicking shape, the sheet interferes with the convex on the downstream side in a rotating direction and floats. Thus, the rear end of the sheet cannot be pushed by the portion of the kicking shape. This led to a problem of poor accommodation due to the leaving the rear end of the sheet.

Further, in order to prevent damage when a thick sheet passes through a nip and poor rotation, it is necessary to reduce the height of the convexes attached to the pinch roll. This requires the performance of kicking out the sheet rear end to be lowered. When the sheet climbs over the convex, this influences the roll nip to generate bending of the sheet. Further, in the case of the elastic blade-like convex, if a fixing roll is arranged in the vicinity of the delivery roll, time-passage deformation was inevitable which is attributable to degradation of the material due to heat or the like.

SUMMARY OF THE INVENTION

A first object of this invention is to provide a sheet delivery mechanism which when a sheet is kicked out by a convex attached to at least one of a first roll and second roll of a sheet delivery roll pair, can prevent poor accommodation due to leaving of a sheet rear end without being hindered by another convex located on the downstream side of the convex.

A second object of this invention is to provide a sheet delivery mechanism which when can deliver a thick sheet without damaging it.

In order to attain the above object, the first feature of this invention is to provide a sheet delivery mechanism characterized by including a sheet delivery roll pair consisting of a first roll and a second roll in contact with each other, wherein at least one of the first roll and the second roll is provided with a plurality of convexes formed circumferentially for pushing the rear end of a sheet to be delivered, and one of these plurality of convexes is arranged to be more inside radially than the tangential line drawn from the radial tip of another convex upstream adjacent in the rotating direction to the one convex to the outer periphery of the roll. In accordance with this configuration, even where the sheet rear end delivered may be left on the first roll or the second roll, when the sheet rear end is kicked out by the convex immediately passed a nip, it is not hindered by the convex located on the downstream side of the above convex. This prevents poor accommodation due to the leaving of the sheet rear end.

This invention is preferably a sheet delivery mechanism wherein a portion more upstream than the radial tip of the one convex has a tapered shape with a gradient approximately equal to the tangential line drawn from the radial tip of another convex upstream adjacent in the rotating direction to the one convex to the outer periphery of the roll. In accordance with this configuration, as compared with the case where a portion more upstream than the radial tip of the convex does not have a tapered shape with a gradient approximately equal to the tangential line drawn from the radial tip of another convex upstream adjacent in the rotating direction to the one convex to the outer periphery of the roll, a larger number of convexes can be arranged on the circumference of the roll and the number of times of kicking out the sheet rear end can be increased. This prevents poor accommodation due to the leaving of the sheet rear end.

This invention is preferably a sheet delivery mechanism wherein the distance from the root of the one convex to a rotation center is shorter than the outer diameter of the roll.

In accordance with this configuration, even where the degree of the convex from the outer periphery of the roll body is relatively small, the sheet rear end can be effectively pushed out. This obviates damages on the image on the sheet which is attributable to the convexes.

The second feature of this invention is to provide a sheet delivery mechanism characterized by including a a sheet delivery roll pair consisting of a first roll and a second roll in contact with each other, wherein at least one of the first roll and the second roll is provided, on its roll body, with a plurality of convexes formed circumferentially for pushing the rear end of a sheet to be delivered to shift inwardly in the radial direction through their elastic deformation; and where a sheet, which receives pressure not lower than a predetermined pressure when it passes a nip, passes the nip, the convex passing the same position as the nip in the rotating direction shifts inwardly in the radial direction, and where the sheet, which receives the pressure lower than the predetermined pressure when it passes the nip, passes the nip, the convex keeps its normal convex shape. In accordance with this configuration, when the thick sheet which receives the pressure not lower than the predetermined pressure passes the nip, the thick sheet can be prevented from being damaged owing to the convex shape. Conventionally, if the degree of the convex from the outer periphery of the roll is increased, the convex must have a lower height permitting the sheet to climb over the convex so that the performance of the convex of kicking out the sheet rear end was limited. But in the above configuration, the degree of the convex can be increased, the performance of kicking out the sheet rear end can be improved.

This invention is preferably is a sheet delivery mechanism wherein the roll body and the convexes are integrally formed of resin, and the convexes are formed in a lightening shape or a shape with recesses on both ends in the axial direction. In accordance with this configuration, as compared with the conventional roll shape, without increasing the production cost and with no time-passage deterioration such as abrasion or settling of the convex, the performance of kicking-out the sheet rear end can be maintained and the image quality can be improved.

This invention is preferably a sheet delivery mechanism wherein the roll body and the convexes are formed separately from each other and made of different materials from each other. In accordance with this configuration, even where the sheet passing distance from the fixing device to the delivery roll pair is so short that the delivery roll is required to have the releasiablity, the image quality and performance of kicking out the sheet rear end can be improved.

This invention is preferably a sheet delivery mechanism wherein the roll body is made of the material selected from the group consisting of tetrafluoroethylene-perfluoroalkylvinylether copolymer (PFA), polytetrafluoroethylene (PTFE) and tetrafluoroethylene-ethylene copolymer (ETFE). For this reason, the roll made of the above material can be given improved slidability and toner releasiablity.

This invention is preferably a sheet delivery mechanism wherein the convexes are made of the material selected from the group consisting of polyacetal (POM), polypropylene (PP) and polycarbonate (PC). For this reason, the convexes can be given improved elastic force and abrasion resistance.

This invention is preferably a sheet delivery mechanism wherein the sheet delivery roll pair serves as an inverting roll for duplex printing. In accordance with this configuration, in the case of duplex printing, in the sheet delivery mechanism, the sheet can be fed out to the inverting path.

This invention is preferably the fixing device wherein the sheet delivery mechanism is internally arranged. In accordance with this configuration, where the sheet delivery mechanism has broken down, the fixing device can be taken out from the image forming apparatus for its replacement or repair. For this reason, as compared with the repair or replacement of the image forming apparatus itself, the cost for repair or replacement can be reduced.

This invention includes an image forming apparatus provided with the sheet delivery mechanism.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
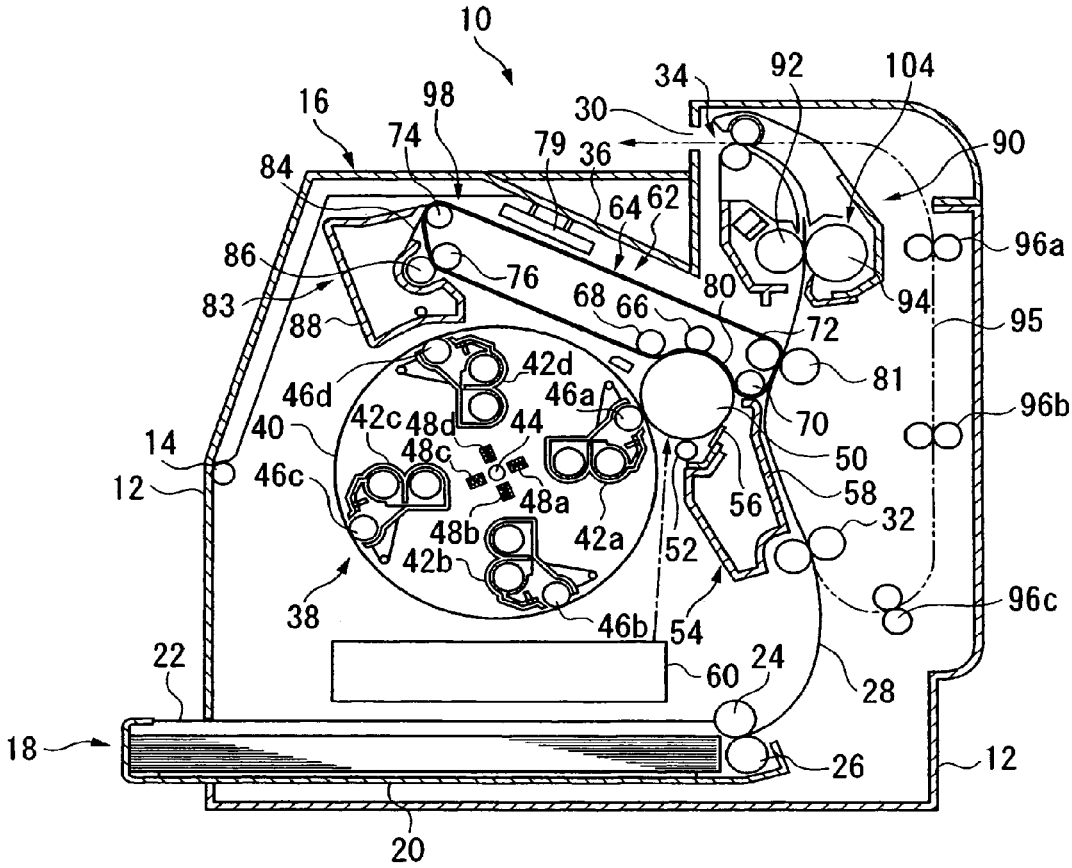
FIG. 1 is a sectional view of an image forming apparatus according to embodiments of this invention.

Now referring to the drawings, an explanation will be given of various embodiments of this invention.

FIG. 1 is an outline of an image forming apparatus 10 according to an embodiment of this invention.

The image forming apparatus 10 has an image forming apparatus body 12 and an opening/closing door 16 which is rotatable around a rotating fulcrum 14 located at an upper position of the image forming apparatus body 12.

At a lower position of the image forming apparatus body 12, e.g. single-stage recording medium feeding unit 18 is located. The recording medium feeding unit 18 includes a recording medium feeding unit body 20 and a recording medium feeding cassette 22 in which recording media are housed. At the upper positions of the depth end of the recording medium feeding cassette 22, located are a feed roll 24 for feeding recording media from the recording medium feeding cassette 22 and a retard roll 26 for individually dressing the recording media to be fed.

A transporting path 28 is a recording medium path from the feed roll 24 to a delivery outlet 30 which is formed from the rear side of the image forming apparatus body 12 toward the inside of the image forming apparatus body 12. The transporting path 28 is formed nearly perpendicularly from the recording medium feeding cassette 22 to a fixing device 90 described later. On the upper stream side of the fixing device 90 on the transporting path 28, arranged are a secondary transfer roll 81 and a secondary backup roll 72. On the upstream side of the secondary transfer roll 81 and secondary backup roll 72, arranged are resist rolls 32. Further, in the vicinity of the delivery outlet 30 of the transporting path 28, a delivery roll pair 34 is arranged which is located as a lower pinch roll (first roll) 100 and an upper follower roll (second roll) 102 which are adapted to be in contact with each other to sandwich a nip 35 therebetween, these rolls being arranged at upper and lower positions within the fixing device 90 as described later. The delivery roll pair 34 is adapted to be rotated in forward and reverse directions by a driving motor not shown.

Therefore, the recording media fed out from the recording medium feeding cassette 22 of the recording medium feeding unit 18 by the feed roll 24 are dressed by the retard roll 26 so that only the uppermost recording medium thereof is guided onto the transporting path 28. The recording medium guided is temporarily stopped by the resist rolls 32, and at an appropriate timing through between the secondary transfer roll 81 and secondary transfer roll 72, a developer is transferred to the recording medium. The image of the developer transferred is fixed by the fixing device 90. In the case of duplex printing, the recording medium guided to the delivery roll pair 34, when the delivery roll pair 34 is inverted, is transported toward the resist rolls 32 again through an inverting path 95. Further, through between the secondary transfer roll 81 and the secondary backup roll 72, a toner image is transferred to the recording medium, and fixed by the fixing device 90. The recording medium is delivered or discharged by the forward rotation of the delivery roll pair 34. A delivery tray 36 slopes so that it is low at the delivery outlet and becomes high toward the front (left direction in FIG. 1).

In the image forming apparatus body 12, for example, at the virtual center on the front side, a rotary developing device 38 is arranged. The rotary developing device 38 has four developing units 42*a* to 42*d* for forming four developer images of Yellow, Magenta, Cyan and Black, respectively within a developing device body 40. These developing units 42*a* to 42*d* rotate counterclockwise in FIG. 1 around the center 44 of the rotary developing device 38. These developing devices 42*a* to 42*d* have developing rolls 46*a* to 46*d*, respectively which are urged in a normal direction of the developing device body 40 by elastic bodies 48*a* to 48*d* such as coil springs. In other words, the developing rolls 46*a* to 46*d* of the developing devices 42*a* to 42*d* are arranged on the outer periphery of the developing device body 40 at intervals of 90° around the rotary developing device center 44, and in their contact with an image carrier 50 described later, they will visualize the electrostatic latent image on the image carrier 50 by the developers of the corresponding colors.

The image carrier 50 is arranged in contact with the rotary developing device 38. The image carrier 50 is made of a tubular aluminum pipe coated with a photoconductive layer on the surface. The photoconductive layer of the image carrier 50 carries the electrostatic latent image formed by a light beam such as a laser beam and developer image visualized by the developer.

Beneath the image carrier 50, a charging device 52 for uniformly the image carrier 50 is arranged which is e.g. a charging roll. Further, in contact with the image carrier 50, a cleaner 54 for the image carrier is arranged on the more upstream side than the charging device 52 in the rotating direction of the image carrier 50. The cleaner 54 for the image carrier includes a cleaning blade for scraping off the developer remaining on the image carrier 50 after e.g. primary transfer and a developer recovering bottle 58 for recovering the developer scraped off by the cleaning blade 56.

Incidentally, the developer recovering bottle 58 is provided, on the rear side (right side in FIG. 1), with e.g. a rib which is curved so that the recording medium is smoothly transported, thereby constituting a part of the transporting path 28.

Below the rotary developing unit 38, an exposure device 60 is arranged for writing the latent image on the image carrier 50 charged by the charging device 52 using the light beam such as a laser beam. Above the rotary developing unit 38, an intermediate transferring device 62 is arranged for primary-transferring the developer image visualized by the rotary developing unit 38 at a primary transfer position and transporting the developer image transported to a secondary transfer position.

The intermediate transferring device 62 includes an intermediate transfer body 64 such as an intermediate transfer belt 64, a primary transfer roll 66, a lap-in-roll 68, a lap-out-roll 70, a secondary transfer backup roll 72, a scraper backup roll 74 and brush backup roll 76. The intermediate transfer body 64 has e.g. elasticity and is stretched nearly flatly to have a long side and short side above the rotary developing unit 38. The long side on the upper side of the intermediate transfer body 64 is stretched so that it is in parallel to the delivery tray 36 arranged at the upper position of e.g. the image forming apparatus body 12. The intermediate transfer body 64 has a primary transfer portion (image carrier lapping region). The intermediate transfer body 64 has a primary transfer portion in contact with the image carrier 50 in its lapping manner, on the lower side of the long sides of the intermediate transfer body 64, between the lap-in-roll 68 arranged upstream of the primary transfer roll 66 and the lap-out-roll 70 arranged downstream of the primary transfer roll 66. With the primary transfer portion lapping in its predetermined range, over the image carrier, the intermediate transfer body 64 follows the rotation of the image carrier 50.

In this way, on the intermediate transfer body 64, the developer image on the image carrier 50 is transferred primarily superposedly by the primary transfer roll 66 in the order of e.g. yellow, magenta, cyan and black. The developer image primarily transferred is transported to the secondary transfer roll 81.

Incidentally, the lap-in-roll 68 and the lap-out-roll 70 are apart from the image carrier 50.

Further, on the rear side of the intermediate transfer body 64 (right side in FIG. 1), the lap-in-roll 68 and the lap-out-roll 70 constitute a planar section (short side) which serves as a secondary transfer portion facing the transporting path 28.

Incidentally, in the secondary transfer body, the lap-out-roll 70 is arranged to form an angle of e.g. 12° between the intermediate transfer body 64 and the transporting path 28.

The scraper backup roll 74 assists a scraper 84 (described later) to scrape off the developer remaining on the intermediate transfer body 64 after the secondary transfer, and the brush backup roll 76 assists a brush roll 86 (described later) to scrape off the developer remaining on the intermediate transfer body 64 after the secondary transfer.

Above the long side of the intermediate transfer body 64, a sensor 79 such as a reflecting type photo-sensor fixed to the rear side (inside) of the opening/closing door 16 is provided. The sensor 79 reads the patch of the developer formed on the intermediate transfer body 64 to detect the position of the intermediate transfer body 64 in the rotating direction and detect the density of the developer.

The secondary transfer backup roll 72 of the intermediate transferring device 62 is opposite to the second transfer roll 81 across the transporting path 28. Namely, the secondary transfer position in the secondary transfer section is located between the secondary transfer roll 81 and the secondary transfer backup roll 72. At the secondary transfer position, the secondary transfer roll 81, under the assistance of the secondary transfer backup roll 72, secondary-transfers the developer image primary-transferred on the intermediate transfer body 64 onto the recording medium. Now, the secondary transfer roll 81 is designed to be apart from the intermediate transfer body 64 while the intermediate transfer body 64 rotates three times, i.e. transports three developer images of yellow, magenta and cyan, and to bring into contact with the intermediate transfer body 64 when the developer image of black is transferred.

Incidentally, a prescribed potential difference is generated between the secondary transfer roll 81 and the secondary transfer backup roll 72. For example, if the secondary transfer roll 81 is at a high voltage, the secondary transfer backup roll 72 is connected to ground (GND). Namely, the intermediate transfer body 64 is placed at a prescribed potential between the secondary transfer roll 81 and secondary transfer backup roll 72.

A cleaner 83 for the intermediate transfer body 64 is arranged in contact with the side end of the intermediate transfer body 64 opposite to the image carrier. The cleaner 83 for the intermediate transfer body 64 includes a scraper 84 for scraping off to clean the developer remaining on the intermediate transfer body 64 after e.g. the secondary transfer, a brush roll 86 for further scraping off the developer remaining after cleaning by the scraper 84 and a developer recovery bottle 88 for recovering the developer scraped off by the scraper 84 and brush roll 86. The scraper 84 is made of e.g. a stainless steel plate. A voltage having an opposite polarity to the developer is applied to the scraper 84. The brush roll 86 is formed of e.g. an acryl brush treated to have conductivity. While the intermediate transfer body 64 is transporting the developer image, the scraper 84 and the brush roll 86 are apart from the intermediate transfer body 64. At a predetermined timing, these components are integrated to bring into contact with the intermediate transfer body 64.

Above the secondary transfer position, the fixing device 90 is arranged. The fixing device 90 includes a heating roll 92 and a pressurizing roll 94 to fix the developer image secondary-transferred on the recording medium by the secondary transfer roll 81 and the secondary transfer backup roll 72 onto the recording medium, and transports the recording medium toward the delivery roll pair 34 provided within the fixing device 90. Further, at an upper position of the fixing device 90, a recording medium passing opening (not shown) is provided. In the case of duplex printing, the delivery roll pair 34 is inverted so that the recording medium is guided to the inverting path 95 and transported toward the resist rolls 32 by means of transporting rolls 96*a* to 96*c*.

An image forming unit 98 is an integrated body consisting of the intermediate transferring device 62, image carrier 50, charging device 52, cleaner 54 for the image carrier and cleaner 83 for the intermediate transfer body. This image forming unit 98 is arranged immediately below the delivery tray 36. The image forming unit is made detachable from the image forming device body 12 by opening the opening/closing door 16.

Next, referring to the drawings, an explanation will be given of the delivery roll pair 34 according to the first embodiment of this invention.

Figure 2:
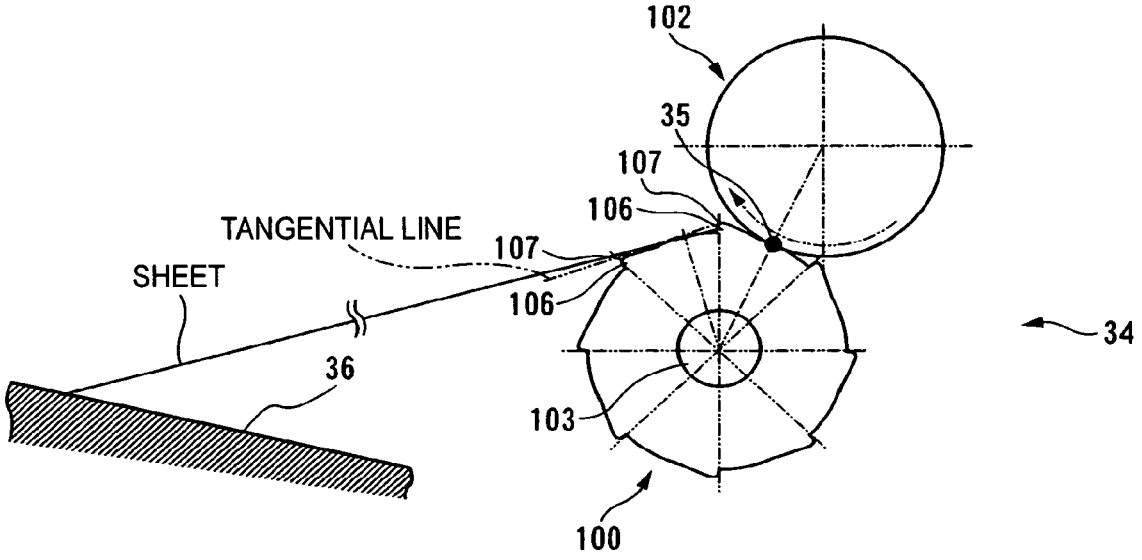
FIG. 2 is a side view of the outline of a sheet delivery roll pair according to the first embodiment of this invention.
Figure 3:
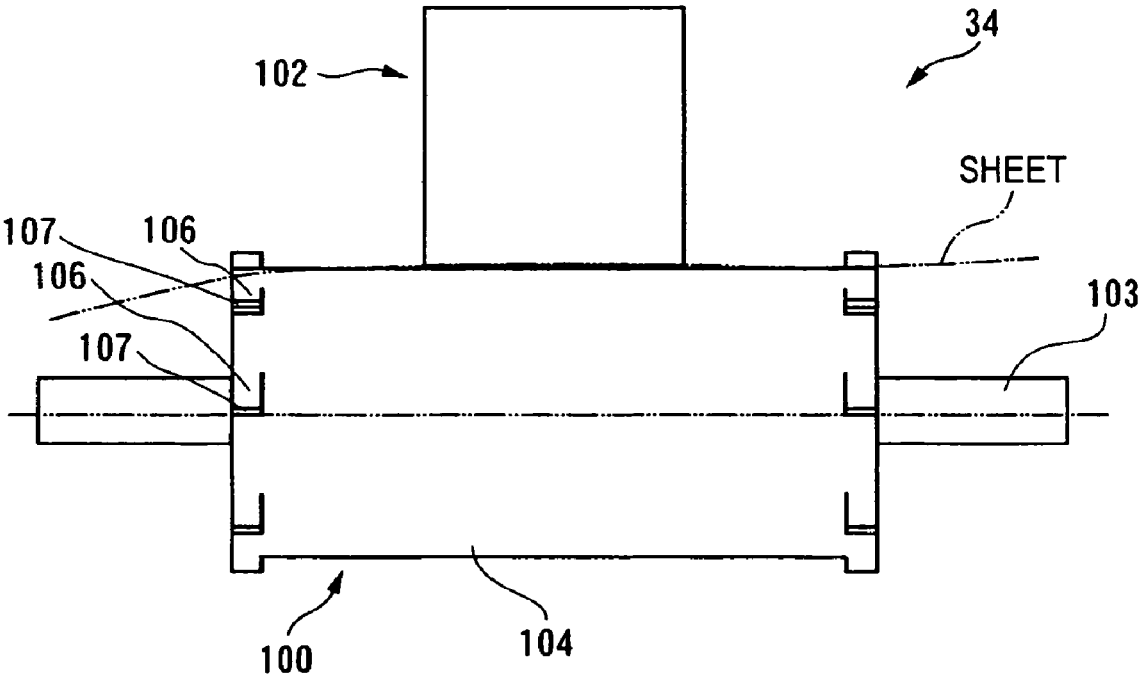
FIG. 3 is a side view of the outline of a sheet delivery roll pair according to the first embodiment of this invention.

FIG. 2 is a side view of the status in the vicinity of the delivery roll pair 34 according to the first embodiment of this invention. FIG. 3 is a side view of the delivery roll pair 34 shown in FIG. 2 when it is viewed from the side of the delivery tray 36.

As seen from FIGS. 2 and 3, the delivery roll pair 34 consists of a lower pinch roll (first roll) 100 and an upper follower roll (second roll) 102 which sandwich the nip 35 therebetween. The pinch roll 100 is provided in a status wider than the follower roll 102 in an axial direction, and located on the side nearer the delivery tray 36 than the follower roll 102.

At the center of rotation of the pinch roll 100, a rotary axis 103 for rotation-driving the pinch roll 100 is provided. The pinch roll 100 includes a roll body 104 and a plurality of convexes 106 formed circumferentially on both ends of the roll body 104. The convexes 106 are provided for pushing the rear end of the sheet to be delivered or discharged. Assuming, as a standard circle, a circle constituted by the outer periphery of the roll body 104 when it is cut in a section perpendicular to the axial direction of the roll body 104, each of the convexes 106 protrudes radially from a standard circle.

Incidentally, because the pinch roll 100 is provided to be wider than the follower roll 102, these convexes 106 will not bring into contact with the follower roll 102.

Figure 4:
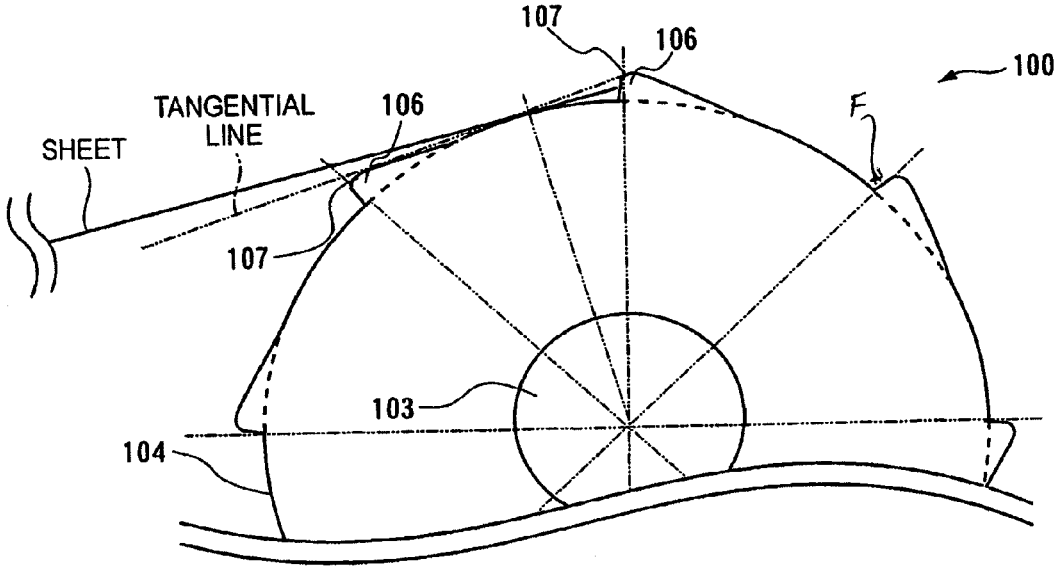
FIG. 4 is an enlarged side view of the main part of a pinch roll of the delivery roll pair shown in FIG. 2.

One of these convexes 106, as shown in FIG. 4 which is an enlarged view of the main part of FIG. 2, is arranged to be more inside radially than the tangential line drawn from the radial tip 107 of another convex 106 upstream adjacent in the rotating direction to the convex 106 at issue to the outer periphery of the roll body 104 of the pinch roll 100.

Thus, even where the rear end of the sheet delivered by the delivery roll pair 34 may be left on the pinch roll 100, without being hindered by the convex 106 after passed the nip 35, the rear end of the sheet can be kicked out by another convex 106 upstream in the rotating direction. This prevents poor accommodation due to the leaving of the sheet rear end.

Incidentally, the portion of the convex 107 of the convex 106 more downstream in the rotating direction than the radial tip 107 of the convex 106, i.e., the face F, is formed to be nearly perpendicular to the outer periphery of the roll body 104 of the pinch roll 100, which is a shape preferable to kick out the sheet rear end.

On the other hand, the portion of the convex 107 more upstream in the rotating direction than the radial tip 107 of the convex 106 has a tapered shape with a gradient approximately equal to the tangential line drawn from the radial tip 107 of another convex 106 upstream adjacent in the rotating direction to the convex 106 at issue to the outer periphery of the roll body 104 of the pinch roll 100. That is, the peripheral surface of the tapered shape has a gradient approximately equal to the tangential line. Thus, in this way, as compared with the case the portion of the convex 107 more upstream in the rotating direction than the radial tip 107 of the convex 106 does not have a gradient equal to the tangential line drawn from the radial tip 107 of another convex 106 upstream adjacent in the rotating direction to the convex 106 at issue to the circumference of the roll body 104 of the pinch roll 100, a larger number of convexes can be arranged on the outer periphery of the pinch roll 100 and the number of times of kicking out the sheet rear end can be increased. This prevents poor accommodation due to the leaving of the sheet rear end.

Further, the delivery roll pair 34 serves as the inverting roll for duplex printing. In the case of the duplex printing, the delivery roll pair 34 is inverted. In this case, as apparent from FIG. 2, since the follower roll 102 is located at the position (right side in FIG. 2) nearer to the inverting path 95 than the pinch roll 100, when the delivery roll pair 34 is employed as the inverting roll, the sheet rear end will not be left on the pinch roll 100.

An explanation will be given of the delivery roll pair 34 according to the second embodiment of this invention.

Figure 5:
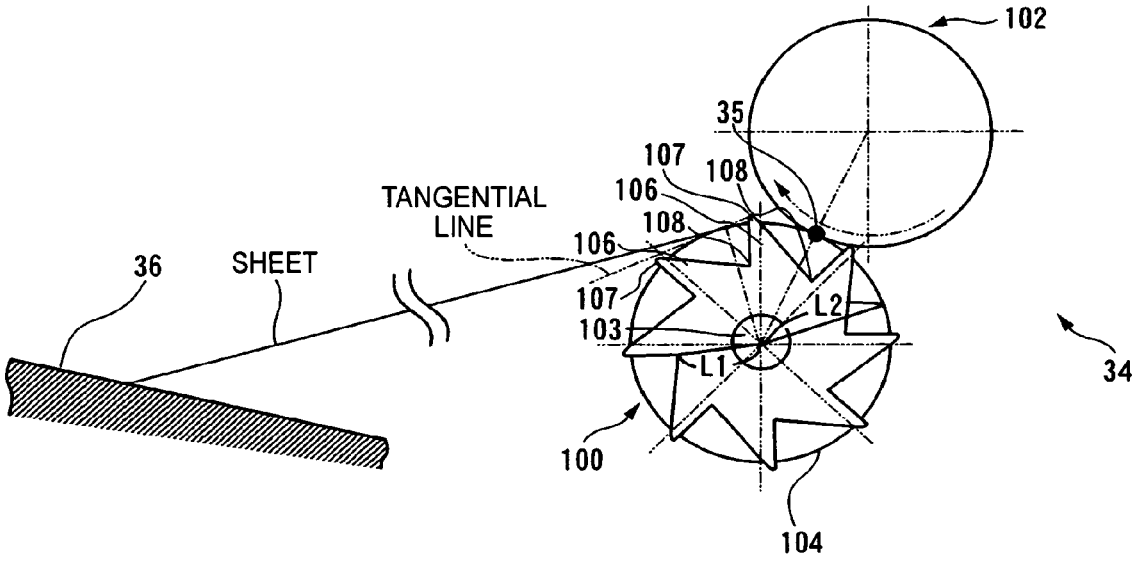
FIG. 5 is a side view of the outline of a sheet delivery roll pair according to the second embodiment of this invention.
Figure 6:
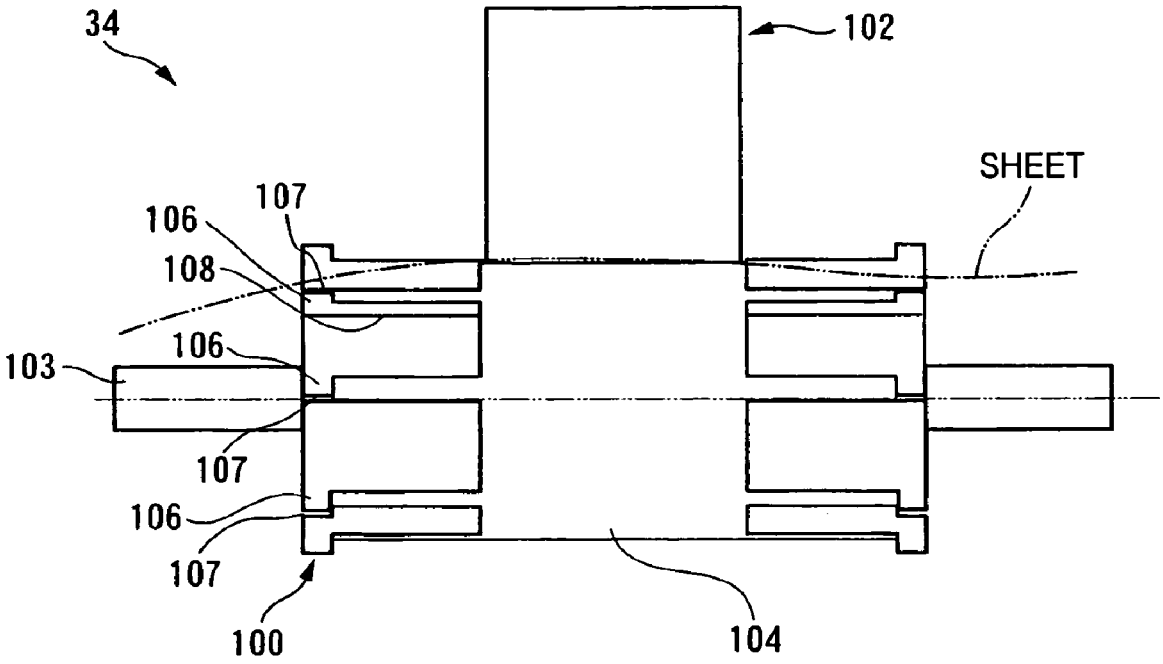
FIG. 6 is a side view of the outline of a sheet delivery roll pair according to the second embodiment of this invention.

FIG. 5 is a side view of the status in the vicinity of the delivery roll pair 34 according to the second embodiment of this invention. FIG. 6 is a side view of the delivery roll pair 34 shown in FIG. 5 when it is viewed from the side of the delivery tray 36.

As seen from FIGS. 5 and 6, the lower pinch roll 100 is circular in section at the zone in contact with the upper follower roll 100. The pinch roll 100 is provided in a status wider than the follower roll 102. The pinch roll 100 is located on the side (left side in FIG. 5) nearer the delivery tray 36 than the follower roll 102. At the center of rotation of the pinch roll 100, a rotary axis 103 for rotation-driving the pinch roll 100 is provided. The pinch roll 100 includes a roll body 104 and a plurality of convexes 106 formed circumferentially on both ends of the roll body 104 not in contact with the follower roll 102. The convexes 106 are provided for pushing the rear end of the sheet to be delivered.

As regards the delivery roll pair 34, as in the delivery roll pair according to the first embodiment, one of these convexes 106 is arranged to be more inside radially than the tangential line drawn from the radial tip 107 of another convex 106 upstream adjacent in the rotating direction to the convex 106 at issue to the outer periphery of the roll body 104 of the pinch roll 100.

In the delivery roll pair 34, the distance L1 from the root 108 of each of the convexes 106 formed on both sides of the roll body 104 to the rotation center is made shorter than the outer diameter L2 of the roll body 104.

Thus, even where the degree of the convex from the outer periphery of the roll body 104 is relatively small, a part of the sheet rear end delivered by the delivery roll pair 34 is bent smoothly as shown in FIG. 6 to enter between the adjacent convexes 106 in the rotating direction on the both ends in the axial direction of the pinch roll 100 so that the sheet rear end can be effectively pushed out. This obviates damages on the image on the sheet which is attributable to the convexes 106.

An explanation will be given of the delivery roll pair 34 according to the third embodiment of this invention.

Figure 7:
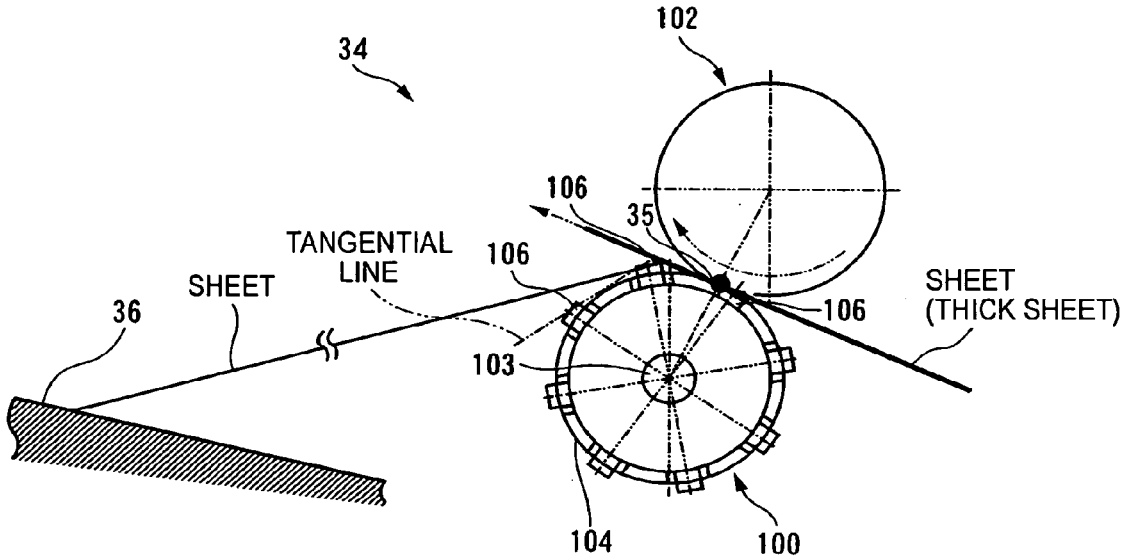
FIG. 7 is a side view of the outline of a sheet delivery roll pair according to the third embodiment of this invention.
Figure 8:
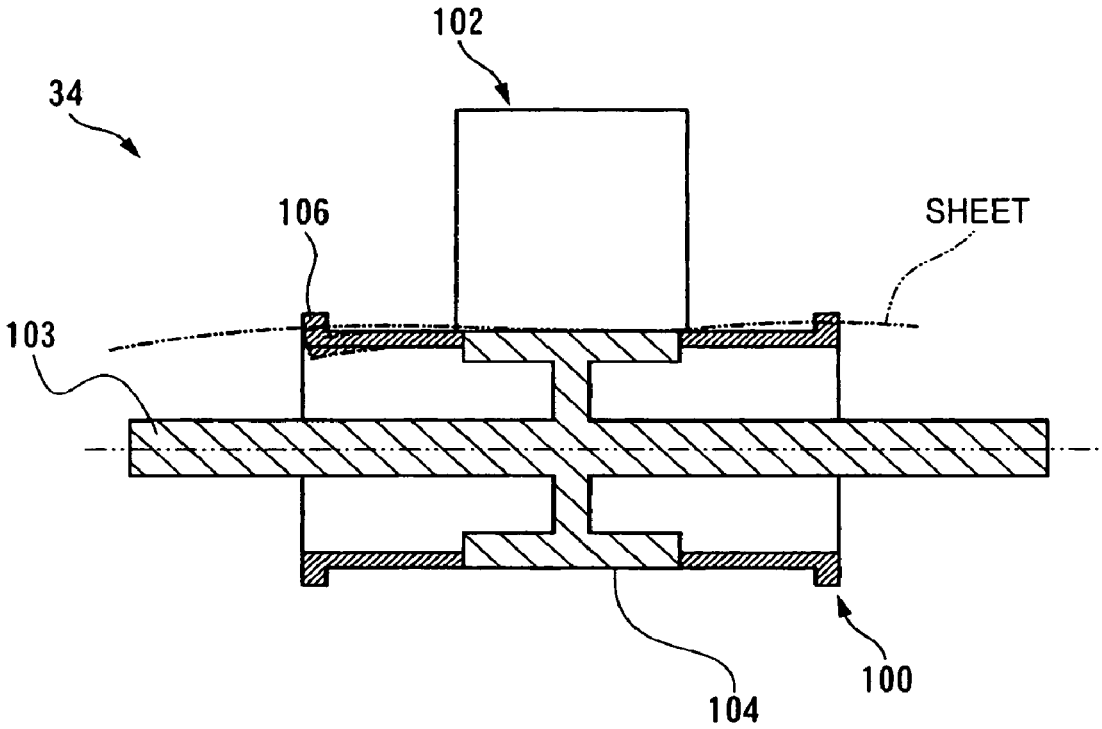
FIG. 8 is a partial sectional view of the outline of a sheet delivery roll pair according to the third embodiment of this invention.

FIG. 7 is a side view of the status in the vicinity of the delivery rolls 34 according to the third embodiment of this invention. FIG. 8 is a partial sectional view of the delivery roll pair 34 shown in FIG. 7 when it is viewed from the side of the delivery tray 36.

The delivery roll pair 34 consists of a lower pinch roll 100 and an upper follower roll 102. The pinch roll 100 is circular in section at the zone in contact with the follower roll 102. The pinch roll 100 is formed in a status wider than the follower roll 102 in an axial direction, and located on the side (left side in FIG. 7) nearer the delivery tray 36 than the follower roll 102. At the center of rotation of the pinch roll 100, a rotary axis 103 for rotation-driving the pinch roll 100 is provided.

The pinch roll 100 includes a roll body 104 and a plurality of convexes 106 formed on both ends in the rotating direction of the roll body 104. The convexes 106 are provided for pushing the rear end of the sheet to be delivered to shift inwardly in the radial direction through their elastic deformation. Incidentally, these convexes 106 are formed integrally to the roll body 104. The convexes 106 are formed in a lightening shape or a shape with recesses on both ends in the axial direction. As regards these convexes 106, when the sheet passes the nip 35 while receiving the pressure not lower than a predetermined pressure, the convex 106 passing the same position as the nip 35 in the rotating direction shifts inwardly through its elastic deformation in the radial direction of the pinch roll 100, i.e. sinks inwardly in the radial direction of the pinch roll 100. On the other hand, when the sheet passes the nip 35 while receiving the pressure lower than the predetermined pressure, the convex 106 keeps its normal convex shape. Thus, for example, where a thick sheet, which receives the pressure not lower than the predetermined pressure, passes the nip 35, the convex 106 passing the nip 35 shifts to the vicinity of the outer periphery of the pinch roll 100 and after having passed the nip 35, the convex 106 returns to the original convex shape.

Thus, when the thick sheet which receives the pressure not lower than the predetermined pressure passes the nip 35, the thick sheet can be prevented from being damaged owing the convex shape. Further, by increasing the degree of the convex, the performance of kicking out the sheet rear end can be improved.

An explanation will be given of the delivery roll pair 34 according to the third embodiment of this invention.

Figure 9:
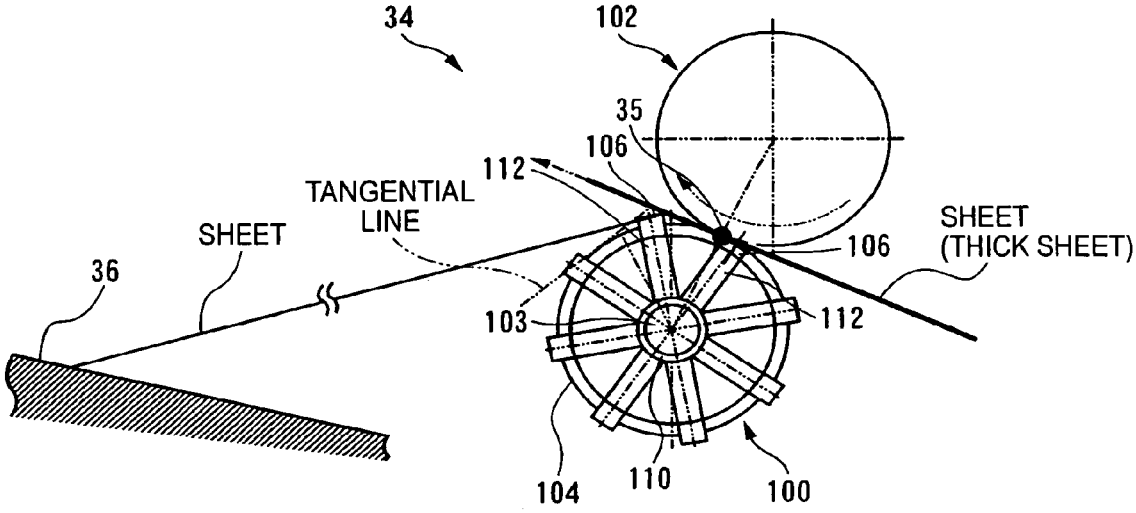
FIG. 9 is a side view of the outline of a sheet delivery roll pair according to the fourth embodiment of this invention.
Figure 10:
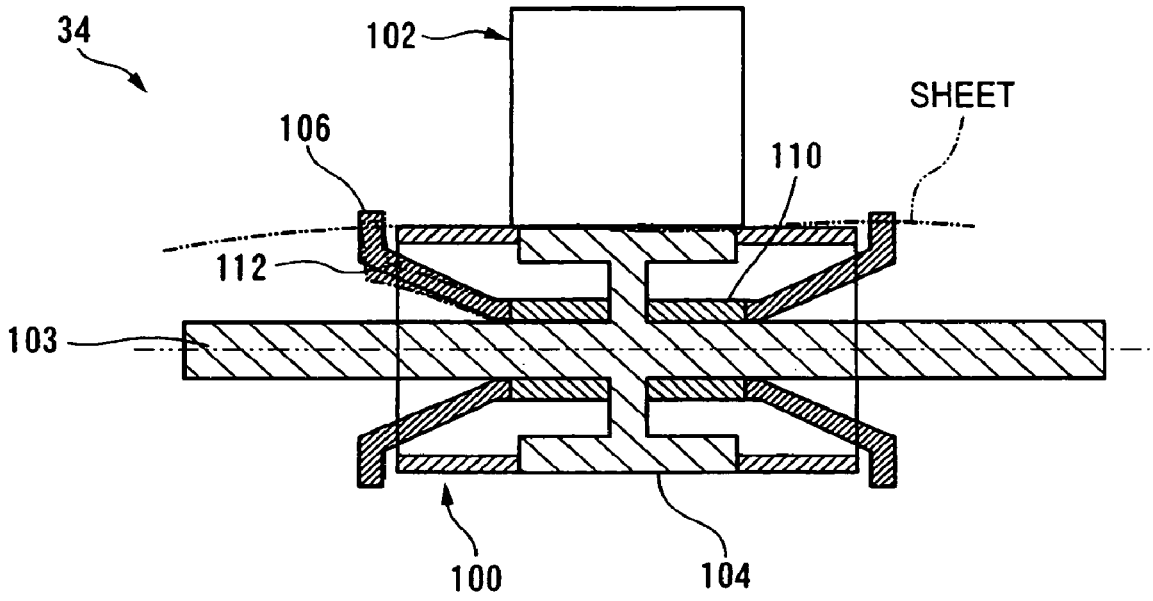
FIG. 10 is a partial sectional view of the outline of a sheet delivery roll pair according to the fourth embodiment of this invention.

FIG. 9 is a side view of the status in the vicinity of the delivery roll pair 34 according to the third embodiment of this invention. FIG. 10 is a partial sectional view of the delivery roll pair 34 shown in FIG. 9 when it is viewed from the side of the delivery tray 36.

The delivery roll pair 34 consists of a lower pinch roll 100 and an upper follower roll 102. As seen from FIGS. 9 and 10, the pinch roll 100 is circular in section at its area in contact with the follower roll 102. The pinch roll 100 is formed in a status wider than the follower roll 102, and located on the side (left side in FIG. 9) nearer the delivery tray 36 than the follower roll 102. At the center of rotation of the pinch roll 100, a rotary axis 103 for rotation-driving the pinch roll 100 is provided.

The pinch roll 100 includes a roll body 104 and a plurality of convexes 106 for pushing the rear end of the sheet to be delivered. The convexes 106 shift inwardly in the radial direction through their elastic deformation. Incidentally, these convexes 106 are formed separately from and made of a different material from the roll body 104.

The roll body 104 is made of any one of tetrafluoroethylene-perfluoroalkylvinylether copolymer (PFA), polytetrafluoroethylene (PTFE) and tetrafluoroethylene-ethylene copolymer (ETFE) which have good slidability and toner-releasibility. On the other hand, the convexes 106 is made of any one of polyacetal (POM), polypropylene (PP) and polycarbonate (PC) which have good elasticity and abrasion resistance.

Thus, even where the sheet passing distance from the fixing device 90 to the delivery roll pair 34 is so short that the pinch roll 100 is required to have the releasiablity, the image quality and performance of kicking out the sheet rear end can be improved.

Incidentally, all the convexes 106 are formed integrally. They are supported by supporting segments 112 which extend from a cylindrical coupling segment 110 to both left and right ends of the roll body 104. In order to mount the convexes 106 on the roll body 104, the supporting segments 112 are deformed inwardly in the radial direction so that they are inserted in the roll body 104, and after the convexes 106 on the end on the one side have passed the interior of the roll body 104, the supporting segments 112 are restored to their original shape. Thus, the convexes are mounted in the roll body 104.

Among these convexes 106, when the sheet passes the nip 35 while receiving the pressure not lower than a predetermined pressure, the convex 106 passing the same position as the nip 35 in the rotating direction shifts through its elastic deformation to the vicinity of the outer periphery of the pinch roll 100. On the other hand, when the sheet passes the nip 35 while receiving the pressure lower than the predetermined pressure, the convex 106 keeps its normal convex shape. Thus, for example, where a thick sheet, which receives the pressure not lower than the predetermined pressure, passes the nip 35, the convex 106 passing the nip 35 shifts to the vicinity of the outer periphery of the pinch roll 100 and after having passed the nip 35, the convex 106 returns to the original convex shape, thus enabling the sheet rear end to be kicked out.

As described hitherto, this invention can be applied to a sheet delivery mechanism which when a sheet is kicked out by a convex attached to at least one of a first roll and second roll of a sheet delivery roll pair, can prevent poor accommodation due to leaving of a sheet rear end without being hindered by another convex located on the downstream side of the convex. Further, this invention can be applied to a sheet delivery mechanism which when can deliver a thick sheet without damaging it.

What is claimed is:

1. A sheet delivery mechanism, comprising:

a first roll having an outer periphery;

a second roll which delivers the sheet with the first roll; and wherein the first roll is provided with a plurality of convexes formed on the outer periphery circumferentially for pushing a rear end of the sheet to be delivered, each of the plurality of convexes includes a curved radial tip portion, a tapered shape extending directly from the radial tip portion in an upstream direction with respect to a rotating direction of the first roll, and a face being a portion of the convex directly downstream in the rotating direction than the radial tip portion;

the tapered shape of one of the plurality of convexes is more inside radially than a line which is drawn from the radial tip portion of an adjacent convex of the plurality of convexes, which is upstream with respect to the rotating direction of the first roll, toward the one of the plurality of convexes so that the line has a gradient that is equal to the tapered shape of the one of the plurality of convexes, a peripheral surface of the tapered shape of the one of the plurality of convexes is approximately equal to a tangential line drawn from the radial tip portion of the one of the plurality of convexes to the upstream direction of the outer periphery of the first roll, and the face has a gradient having an angle with respect to the outer periphery of the first roll that is larger than an angle of the tapered shape with respect to the outer periphery of the first roll.

2. The sheet delivery mechanism according to claim 1, wherein the first roll and the second roll of the sheet delivery roll pair serve inverting rolls for duplex printing.

3. The sheet delivery mechanism according to claim 1, wherein the first roll includes a rotary axis, and the second roll is driven by rotation of the first roll and is provided at an upper side of the first roll, and the first roll is provided near to the delivery tray than the second roll.

4. The sheet delivery mechanism according to claim 1, wherein the tangential line is drawn from a position where the curved radial tip portion of the one of the plurality of convexes contacts the tapered shape of the one of the plurality of convexes.

5. An image forming apparatus comprising:

a recording medium feeding unit that feed a sheet;

a fixing device that fixes a developer image on the sheet; and a transporting path that is arranged from the recording medium feeding unit to the fixing device, wherein the fixing device comprises a sheet delivery mechanism including:

a first roll having an outer periphery;

a second roll which delivers the sheet with the first roll;

wherein each of the plurality of convexes includes a curved radial tip portion, and a tapered shape extending directly from the radial tip portion in an upstream direction with respect to a rotating direction of the first roll, and a face being a portion of the convex directly downstream in the rotating direction than the radial tip portion provided at a downstream side of the radial tip with respect to the rotating direction;

the tapered shape of one of the plurality of convexes is more inside radially than a line which is drawn from the radial tip portion of an adjacent convex of the plurality of convexes, which is upstream with respect to the rotating direction of the first roll, toward the one of the plurality of convexes so that the line has a gradient that is equal to the tapered shape of the one of the plurality of convexes, a peripheral surface of the tapered shape of the one of the plurality of convexes is approximately equal to a tangential line drawn from the radial tip portion of the one of the plurality of convexes to the upstream direction of the outer periphery of the first roll, and the face has a gradient having an angle with respect to the outer periphery of the first roll that is larger than an angle of the tapered shape with respect to the outer periphery of the first roll.

* * * * *